US009613569B2

(12) United States Patent
Yin

(10) Patent No.: US 9,613,569 B2
(45) Date of Patent: Apr. 4, 2017

(54) PIXEL UNIT DRIVING CIRCUIT, DISPLAY SUBSTRATE, DISPLAY PANEL AND DISPLAY DEVICE

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/445,525

(22) Filed: Jul. 29, 2014

(65) Prior Publication Data

US 2015/0302787 A1 Oct. 22, 2015

(30) Foreign Application Priority Data

Apr. 18, 2014 (CN) ..... 2014 1 0159033

(51) Int. Cl.
*G09G 3/20* (2006.01)
*G09G 3/32* (2016.01)

(52) U.S. Cl.
CPC ..... *G09G 3/3233* (2013.01)

(58) Field of Classification Search
CPC ..... G09G 3/3233
USPC ..... 345/211, 690–694
See application file for complete search history.

(56) References Cited

U.S. PATENT DOCUMENTS

2003/0117388 A1* 6/2003 Koyama ..... 345/211
2007/0159099 A1* 7/2007 Takahashi ..... G09G 3/3233 313/512
2012/0139959 A1* 6/2012 Kim ..... 345/690
2013/0070007 A1* 3/2013 Park ..... G09G 3/3233 345/694
2013/0208015 A1* 8/2013 Kim et al. ..... 345/690
2013/0235013 A1* 9/2013 Chiu et al. ..... 345/211
2014/0354701 A1* 12/2014 Yeo ..... 345/690

FOREIGN PATENT DOCUMENTS

| | | | |
|---|---|---|---|
| CN | 1645445 | A | 7/2005 |
| CN | 1831922 | A | 9/2006 |
| CN | 1920908 | A | 2/2007 |
| CN | 102486910 | A | 6/2012 |
| CN | 203773913 | U | 8/2014 |
| JP | 2002175045 | A | 6/2002 |
| JP | 2006146024 | A | 6/2006 |

OTHER PUBLICATIONS

First Office Action of the Chinese Patent Application No. 201410159033.0, issued Aug. 5, 2015, and its English Translation.

* cited by examiner

*Primary Examiner* — Tony Davis
(74) *Attorney, Agent, or Firm* — Nath, Goldberg & Meyer; Joshua B. Goldberg

(57) ABSTRACT

The invention provides a pixel unit driving circuit, a display substrate, a display panel and a display device. The pixel unit driving circuit is used for driving a plurality of pixel units, wherein each of the pixel units comprises sub-pixels of different colors. The pixel unit driving circuit comprises a plurality of driving powers corresponding to the sub-pixel of different colors, wherein the sub-pixels of a same color are connected with a same driving power, and each of the driving powers is used for supplying a corresponding driving voltage to the sub-pixels of a color corresponding to the driving power.

1 Claim, 2 Drawing Sheets

PIXEL UNIT DRIVING CIRCUIT, DISPLAY SUBSTRATE, DISPLAY PANEL AND DISPLAY DEVICE

FIELD OF THE INVENTION

The present invention relates to the field of display technology, and particularly relates to a pixel unit driving circuit, a display substrate, a display panel and a display device.

BACKGROUND OF THE INVENTION

Compared to the Thin Film Transistor Liquid Crystal Display (TFT-LCD) which is the main display technology at the present, the Organic Light Emitting Diode (OLED) display now has become the focus of concern due to its advantages of wide view angle, high brightness, high contrast, low power consumption, small thickness and volume, and the like.

The driving methods for the OLED display may be classified into two types, i.e., Passive Matrix (PM) driving and Active Matrix (AM) driving. Compared to PM driving, AM driving has advantages of large amount of display information, low power consumption, long service life of devices, high contrast of images, and so on. In an AMOLED display in the prior art, as shown in FIG. 1, the equivalent circuit of the basic principle of the pixel unit driving circuit comprises a switching transistor M1, a driving transistor M2, a storage capacitor C1, and a light emitting device D1, wherein the drain of the switching transistor M1 is connected with the gate of the driving transistor M2, the gate of the driving transistor M2 is also connected with one end of the storage capacitor C1, the source of the driving transistor M2 is connected with the other end of the storage capacitor C1, and the drain of the driving transistor M2 is connected with the light emitting device D1. The switching transistor M1 is switched ON when its gate is gated by the scanning signal Vscan(n) so that the data signal Vdata is introduced therein from its source. The driving transistor M2 typically works in the saturation region, and its gate-source voltage Vgs determines the amount of the current flowing through the driving transistor M2 so as to apply stable current to the light emitting device D1, wherein Vgs=Vdata−VD1, and VD1 is the voltage drop across the light emitting device D1 when the light emitting device D1 has a luminance of the highest gray scale. VDD is a stabilized voltage or a stabilized current supply, is connected to the source of the driving transistor M2, and supplies the energy needed for causing the light emitting device D1 to emit light. The storage capacitor C1 serves to stabilize the gate voltage of the driving transistor M2 during one frame period.

Typically, a pixel unit driving circuit of the OLED display comprises sub-pixels of three different colors of Red (R), Green (G) and Blue (B). As shown in FIG. 2, it is easily seen that: although the light emitting layers of the sub-pixels of different colors are fabricated with different materials, the pixel unit driving circuit of the OLED display drives the red organic light emitting device DR, the blue organic light emitting device DB and the green organic light emitting device DG in the pixel unit by the driving voltage VDD of the same driving power (the voltage of the driving power is a driving voltage necessary for the largest luminance of the blue organic light emitting device DB). However, since the light emitting layers in the organic light emitting devices of the three different colors have different semiconductor materials, the voltage drops across the organic light emitting devices of the three different colors are different from each other. It can be seen from FIG. 3 that, when the sub-pixels of three colors have identical display luminance, the voltage drop across the blue organic light emitting device DB is larger than the voltage drop across the red organic light emitting device DR, and the voltage drop across the red organic light emitting device DR is larger than the voltage drop across the green organic light emitting device DG. Because the pixel unit driving circuit of the OLED display drives the organic light emitting devices of three different colors in the display by the same driving power voltage, the difference between the actual voltage drop across the driving transistor TG of the green sub-pixel and the voltage drop necessary for itself is the largest, the difference between the actual voltage drop across the driving transistor TR of the red sub-pixel and the voltage drop necessary for itself is the second largest, and the difference between the actual voltage drop across the driving transistor TB of the blue sub-pixel and the voltage drop necessary for itself is the smallest. Thus, the power consumption on the driving transistor TG of the green sub-pixel is too large, which results in resource waste. Furthermore, since the bias voltages of the driving transistors in the sub-pixels of the three different colors are different from each other, the driving transistors cannot work with their best driving ability.

SUMMARY OF THE INVENTION

Aimed to the problem that the existing pixel unit driving circuit has large power consumption, the invention provides a pixel unit driving circuit, a display substrate, a display panel and a display device which can reduce power consumption and improve the driving ability.

The technical solution for solving the above technical problem is a pixel unit driving circuit for driving a plurality of pixel unit, each of the pixel units comprising sub-pixels of different colors, each of the sub-pixels comprising a driving transistor and an organic light emitting device corresponding to the color of the sub-pixel, characterized in that, the pixel unit driving circuit comprising a plurality of driving powers corresponding to the sub-pixels of different colors, wherein the sub-pixels of a same color are connected with a same driving power, and each of the driving powers is used for supplying corresponding driving voltage to the sub-pixels of a color corresponding to the driving power.

Since the sub-pixels of different colors in the pixel unit driving circuit of the invention are connected to different driving powers, an appropriate driving power may be selected according to the color of the sub-pixel so as to provide corresponding driving voltage to the sub-pixel. In this way, the voltage across the driving transistor in each sub-pixel may be lower than the voltage across the driving transistor in the prior art, and thereby the power consumption of the driving transistor may be reduced. Obviously, the power consumption of the whole pixel unit driving circuit is also decreased.

Preferably, the driving voltage of each driving power is equal to a sum of a voltage drop across the organic light emitting device in the sub-pixel corresponding to the driving power when the organic light emitting device works with its largest gray scale luminance and a bias voltage of the driving transistor.

Preferably, each of the pixel units comprises a red sub-pixel, a green sub-pixel and a blue sub-pixel, wherein the red sub-pixel comprises a red organic light emitting device and a first driving transistor;

the green sub-pixel comprises a green organic light emitting device and a second driving transistor; and the blue sub-pixel comprises a blue organic light emitting device and a third driving transistor.

Further preferably, the driving powers include a first driving power, a second driving power and a third driving power, wherein a driving voltage of the first driving power is equal to a sum of a voltage drop across the red organic light emitting device when the red organic light emitting device works with its largest gray scale luminance and a bias voltage of the first driving transistor;

a driving voltage of the second driving power is equal to a sum of a voltage drop across the green organic light emitting device when the green organic light emitting device works with its largest gray scale luminance and a bias voltage of the second driving transistor; and a driving voltage of the third driving power is equal to a sum of a voltage drop across the blue organic light emitting device when the blue organic light emitting device works with its largest gray scale luminance and a bias voltage of the third driving transistor.

Further preferably, the driving voltage of the first driving power is larger than the driving voltage of the second driving power, and the driving voltage of the third driving power is larger than the driving voltage of the first driving power.

The technical solution for solving the above technical problem is a display substrate comprising the above mentioned pixel unit driving circuit.

Since the display substrate of the invention comprises the above pixel unit driving circuit, its power consumption may be lowered.

The technical solution for solving the above technical problem is a display panel comprising the above mentioned display substrate.

Since the display panel of the invention comprises the above display substrate, its power consumption may be lowered, the driving ability of the driving transistor may be improved and thereby the display effect may be improved.

The technical solution for solving the above technical problem is a display device comprising the above mentioned display panel.

Since the display device of the invention comprises the above display panel, it has improved display effect along with reduced power consumption.

DETAILED DESCRIPTION OF THE EMBODIMENTS

Figure 1:
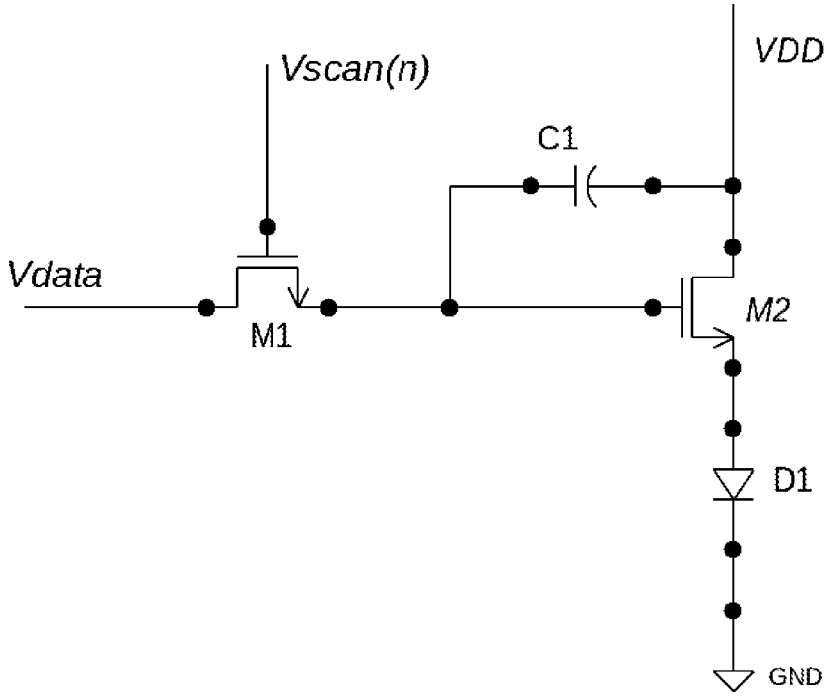
FIG. 1 is a schematic diagram showing the driving circuit of each sub-pixel in the pixel unit driving circuit of the existing OLED display.
Figure 2:
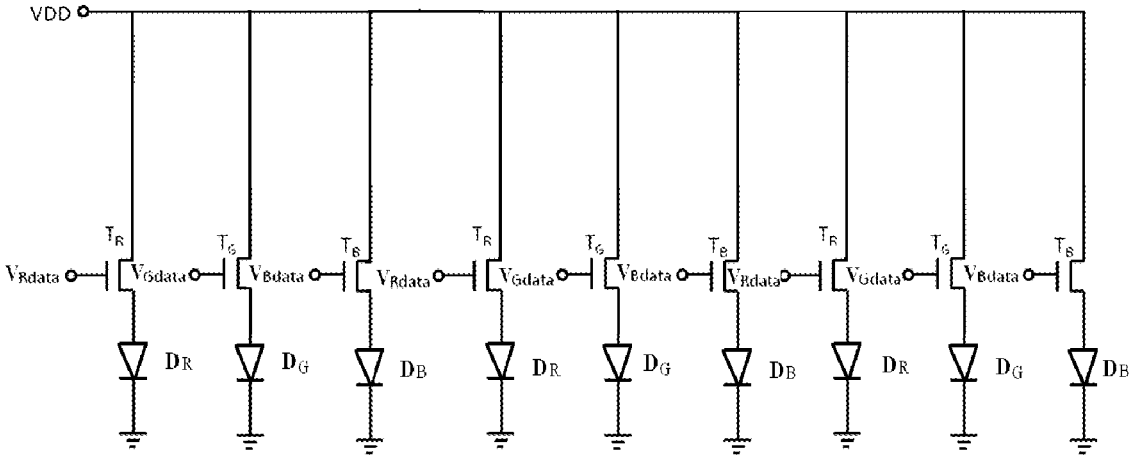
FIG. 2 is a schematic diagram showing the equivalent circuit of the basic principle of the pixel unit driving circuit of the existing OLED display.
Figure 3:
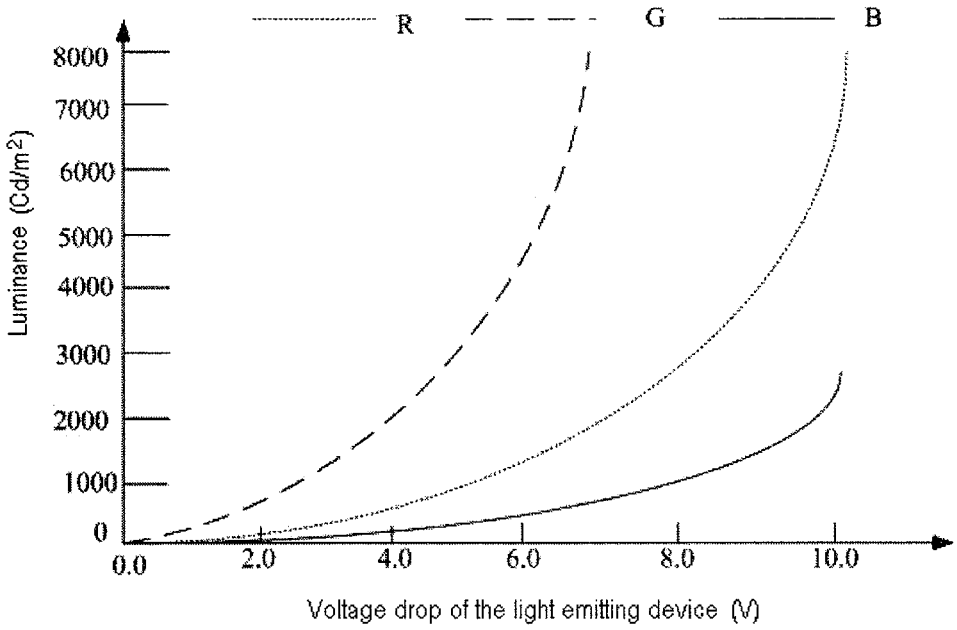
FIG. 3 is a graph of the relationships between the luminance and the voltage drop for the red, green and blue organic light emitting devices.

Hereinafter, the invention will be described in detail with reference to the drawings along with specific embodiments in order that the technical solution of the invention can be fully understood by skilled persons in the art.

The invention provides a pixel unit driving circuit for driving a plurality of pixel units, wherein each of the pixel units comprises sub-pixels of different colors. Each sub-pixel comprises a driving transistor and an organic light emitting device corresponding to the color of the sub-pixel. The pixel unit driving circuit further comprises a plurality of driving powers corresponding to the sub-pixels of different colors, in which the sub-pixels of a same color are connected to a same driving power, and each driving power is used for supplying a corresponding driving voltage to the sub-pixels of a color corresponding to this driving power.

It will be understood by a person skilled in the art that, the driving voltage supplied by one driving power may be at least equal to the driving voltage causing the organic light emitting device connected with this driving power to have the largest luminance. Since the driving voltages needed for the organic light emitting devices of different colors when they have the largest luminance are different, in the pixel unit driving circuit according to the invention, the sub-pixels of different colors are connected to different driving powers. Thus, an appropriate driving power may be selected according to the color of a sub-pixel so as to supply a corresponding driving voltage to the sub-pixel. In this way, the voltage across the driving transistor in each sub-pixel may be reduced with respect to the voltage across the driving transistor in the prior art, thereby the power consumption of the driving transistor may be decreased. Obviously, the power consumption of the whole pixel unit driving circuit may also be decreased.

In the pixel unit driving circuit according to the invention, the driving voltage of each driving power is equal to the sum of the voltage drop across the organic light emitting device in the sub-pixel corresponding to the driving power when the organic light emitting device works with the largest gray scale luminance and the bias voltage of the driving transistor. It will be understood by a person skilled in the art that a bias voltage of a driving transistor generally means a voltage between the base and the emitter (or between the gate and the source) or a voltage between the collector and the base (or between the drain and the gate) which should be set for the amplification state of the transistor in the transistor amplifying circuit. Herein, the bias voltage of the driving transistor means the voltage between the gate and the source which should be set for the amplification state of the driving transistor. With the pixel unit driving circuit of the invention, the power consumption of the pixel unit driving circuit may be reduced as much as possible while the driving ability of the driving transistors may be improved.

Figure 4:
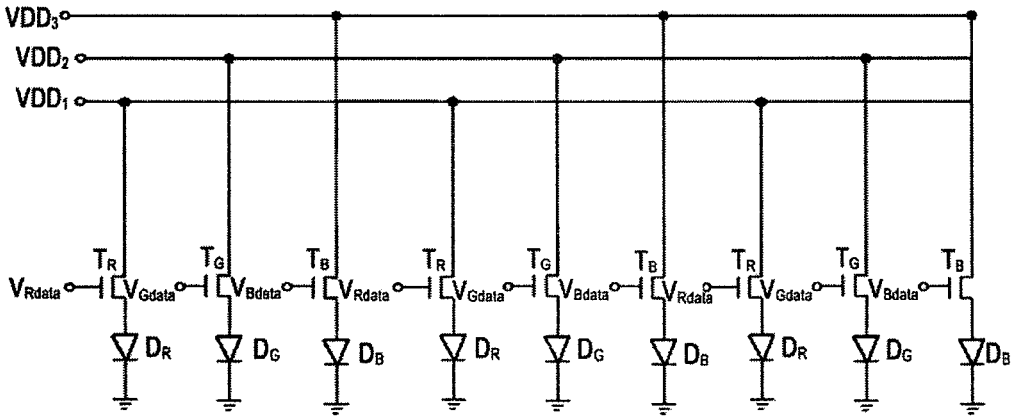
FIG. 4 is a partial schematic diagram of the basic principle of the driving circuit of the pixel unit according to an embodiment of the invention.

FIG. 4 is a partial schematic diagram of the basic principle of the driving circuit of the pixel unit according to an embodiment of the invention. As shown in FIG. 4, each pixel unit in the pixel unit driving circuit preferably comprises a red sub-pixel, a green sub-pixel, and a blue sub-pixel. The red sub-pixel comprises a red organic light emitting device DR and a driving transistor TR, the green sub-pixel comprises a green organic light emitting device DG and a driving transistor TG and the blue sub-pixel comprises a blue organic light emitting device DB and a driving transistor TB. Further preferably, the pixel unit driving circuit comprises a first driving power VDD1, a second driving power VDD2 and a third driving power VDD3. The first driving power VDD1 is used for driving the red sub-pixel, and its driving voltage is equal to a sum of the voltage drop across the red organic light emitting device DR when the red organic light emitting device DR works with the largest gray scale luminance and the bias voltage of the driving transistor TR. The second driving power VDD2 is used for driving the green sub-pixel, and its driving voltage is equal to a sum of the voltage drop across the green organic light emitting device DG when the green organic light emitting device DG works with the largest gray scale luminance and the bias voltage of the driving transistor TG. The third driving power VDD3 is used for driving the blue sub-pixel, and its driving voltage is equal to a sum of the voltage drop across the blue organic light emitting device DB when the blue organic light emitting device DB works with the largest gray scale luminance and the bias voltage of the driving transistor TB.

Since the light emitting materials of the organic light emitting devices of the three colors (red, green and blue) are different from each other, the voltage drops across the organic light emitting devices of the three colors when they work with their respective largest gray scale luminance are different from each other, and there is the following relational expression: $V_{OLEDG}<V_{OLEDR}<V_{OLEDB}$, wherein $V_{OLEDG}$, $V_{OLEDR}$ and $V_{OLEDB}$ are the voltage drops across the green organic light emitting device DG, the red organic light emitting device DR and the blue organic light emitting device DB when they work with their respective largest gray scale luminance, respectively. Thus, further preferably, the driving voltage of the first driving power VDD1 is larger than that of the second driving power VDD2, and the driving voltage of the third driving power VDD3 is larger than that of the first driving power VDD1. It should be noted that the models of the driving transistors in different sub-pixels are identical, and the different reference signal TR, TG and TB for the driving transistors are simply used to indicate that the driving transistors are provided in different sub-pixels respectively.

It should be noted that, in the present embodiment, each sub-pixel comprises a driving transistor and an organic light emitting device. However, in addition to the driving transistor and the organic light emitting device, each sub-pixel may further comprise a switching transistor and a storage capacitor (for example, as the sub-pixel with 2T1C shown in FIG. 1, or a sub-pixel with other configuration such as that with 6T2C). In the embodiment of the invention as shown in FIG. 4, the above elements are not shown simply for the sake of convenience. Furthermore, the switching transistor is equivalent to a lead wire when it is switched ON, so as to transfer different data signals to the organic light emitting device to adjust the luminance of the organic light emitting device, and thereby display with different gray scale is achieved.

As stated above, the pixel unit driving circuit of the invention has reduced power consumption along with improved driving ability of the thin film transistor.

The invention further provides a display substrate which comprises the above pixel unit driving circuit according to the invention.

Since the display substrate of the invention comprises the above pixel unit driving circuit, it has lower power consumption and better performance.

Obviously, the display substrate of the invention further comprises other known elements such as gate line, data line and so on.

The invention further provides a display panel which comprises the above display substrate according to the invention.

Since the display panel comprises the display substrate according to the invention, it has lower power consumption and better performance.

The invention further provides a display device which comprises the above display panel according to the invention. The display device may be any product or component having display function, such as a mobile telephone, a tablet PC, a television, a display, a notebook computer, a digital album, navigator, and so on.

Since the display device of the invention has the above display panel according to the invention, it has lower power consumption and better performance.

Obviously, the display device of the invention may further comprise other ordinary structures, such as a power supply unit, display driving unit and the like.

It will be understood that, the above embodiment is described only for explaining the principle of the invention, but not used for limiting the invention. It is obviously for a person skilled in the art that various modifications and improvements may be made without departing from the scope of the invention, which should be also deemed as falling into the protective scope of the invention.

The invention claimed is:

1. A pixel unit driving method for driving a plurality of pixel units, each of the plurality of pixel units comprising sub-pixels of different colors, each of the sub-pixels comprising a driving transistor and an organic light emitting device corresponding to the color of this sub-pixel, the method comprising:

providing a plurality of driving powers corresponding to the sub-pixels of different colors, wherein the sub-pixels of a same color are connected with a same driving power of the plurality of driving powers, and each of the plurality of driving powers is used for supplying a corresponding driving voltage to the sub-pixels of a color corresponding to this driving power; and applying each of the plurality of driving powers with a driving voltage which is equal to a sum of a voltage drop across the organic light emitting device in the sub-pixel corresponding to this driving power when the organic light emitting device works with its largest gray scale luminance and a bias voltage of the driving transistor, wherein each of the pixel units comprises a red sub-pixel, a green sub-pixel and a blue sub-pixel, wherein the red sub-pixel comprises a red organic light emitting device and a first driving transistor the green sub-pixel comprises a green organic light emitting device and a second driving transistor; and the blue sub-pixel comprises a blue organic light emitting device and a third driving transistor, wherein the driving powers include a first driving power, a second driving power and a third driving power, wherein applying the first driving power with the driving voltage which is equal to a sum of a voltage drop across the red organic light emitting device when the red organic light emitting device works with its largest gray scale luminance and the bias voltage of the first driving transistor;

applying the second driving power with the driving voltage which is equal to a sum of a voltage drop across the green organic light emitting device when the green organic light emitting device works with its largest gray scale luminance and the bias voltage of the second driving transistor; and applying the third driving power with the driving voltage which is equal to a sum of a voltage drop across the blue organic light emitting device when the blue organic light emitting device works with its largest gray scale luminance and the bias voltage of the third driving transistor, and wherein the driving voltage of the first driving power is larger than the driving voltage of the second driving power, and the driving voltage of the third driving power is larger than the driving voltage of the first driving power.

* * * * *